US009372457B2

(12) United States Patent
Yamagishi et al.

(10) Patent No.: US 9,372,457 B2
(45) Date of Patent: Jun. 21, 2016

(54) FIXING DEVICE AND IMAGE FORMING APPARATUS

(71) Applicant: KYOCERA Document Solutions Inc., Osaka (JP)

(72) Inventors: Yoshihiro Yamagishi, Osaka (JP); Satoshi Ishii, Osaka (JP); Takashi Eiki, Osaka (JP); Takefumi Yotsutsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/925,474

(22) Filed: Oct. 28, 2015

(65) Prior Publication Data

US 2016/0132005 A1 May 12, 2016

(30) Foreign Application Priority Data

Nov. 7, 2014 (JP) ..... 2014-227113

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/205; G03G 15/2046; G03G 15/2053
USPC ..... 399/33, 329
See application file for complete search history.

(56) References Cited

U.S. PATENT DOCUMENTS 8,971,735 B2 * 3/2015 Yoshimura ..... G03G 15/205 399/33
2011/0026983 A1 * 2/2011 Okamoto ..... G03G 15/2064 399/329
2013/0195477 A1 8/2013 Seshita et al.

FOREIGN PATENT DOCUMENTS

JP 2013-178472 A 9/2013

* cited by examiner

*Primary Examiner* — William J Royer
(74) *Attorney, Agent, or Firm* — Studebaker & Brackett PC

(57) ABSTRACT

A fixing device includes a fixing belt, a pressuring member, a heat source, a pressing member, a heating stop device, shape restricting members and biasing members. The fixing belt is provided to be rotatable around a rotation axis. The pressing member is provided to be rotatable and to come into pressure contact with the fixing belt so as to form a fixing nip. The heat source heats the fixing belt. The pressing member presses the fixing belt to a side of the pressuring member. The heating stop device faces an outer circumferential face of the fixing belt and to operate at an operating temperature so as to stop the heat source from heating the fixing belt. The shape restricting members are attached to both end parts of the fixing belt and restricts a shape of the fixing belt.

10 Claims, 7 Drawing Sheets

FIXING DEVICE AND IMAGE FORMING APPARATUS

INCORPORATION BY REFERENCE

This application is based on and claims the benefit of priority from Japanese Patent application No. 2014-227113 filed on Nov. 7, 2014, the entire contents of which are incorporated herein by reference.

BACKGROUND

The present disclosure relates to a fixing device configured to fix a toner image onto a recording medium and an image forming apparatus including the fixing device.

Conventionally, an electrographic image forming apparatus, such as a copying machine or a printer, includes a fixing device configured to fix a toner image onto a recording medium, such as a sheet.

For example, there is a fixing device including a fixing belt, a pressuring member configured to come into pressure contact with the fixing belt so as to form a fixing nip, a heat source configured to heat the fixing belt, a heating stop device configured to face an outer circumferential face of the fixing belt. In such a fixing device, upon an excessive rise in temperature of the fixing belt, the heating stop device operates so as to stop the fixing belt from heating by the heat source.

In the fixing device configured as described above, there is a concern that, when a facing interval between the fixing belt and the heating stop device is too narrow, the heating stop device operates even though the temperature of the fixing belt does not excessively rise. On the other hand, there is a concern that, when the facing interval is widened, if the fixing belt is broken in the circumferential direction, a timing at which the heating stop device operates delays.

SUMMARY

In accordance with an embodiment of the present disclosure, a fixing device includes a fixing belt, a pressuring member, a heat source, a pressing member, a heating stop device, shape restricting members and biasing members. The fixing belt is configured to be rotatable around a rotation axis. The pressing member is configured to be rotatable and to come into pressure contact with the fixing belt so as to form a fixing nip. The heat source is configured to heat the fixing belt. The pressing member is configured to press the fixing belt to a side of the pressuring member. The heating stop device is configured to face an outer circumferential face of the fixing belt and to operate at an operating temperature so as to stop the heat source from heating the fixing belt. The shape restricting members are attached to both end parts of the fixing belt and restricts a shape of the fixing belt. The biasing members are configured to bias the shape restricting members toward an inside in a direction of the rotation axis. When the fixing belt is broken in a circumferential direction, the shape restricting members move toward the inside in the direction of the rotation axis by biasing force of the biasing members and the shape restricting members press the fixing belt toward the inside in the direction of the rotation axis so that at least a part of the fixing belt is deformed to a close side to the heating stop device.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

First Embodiment

Figure 1:
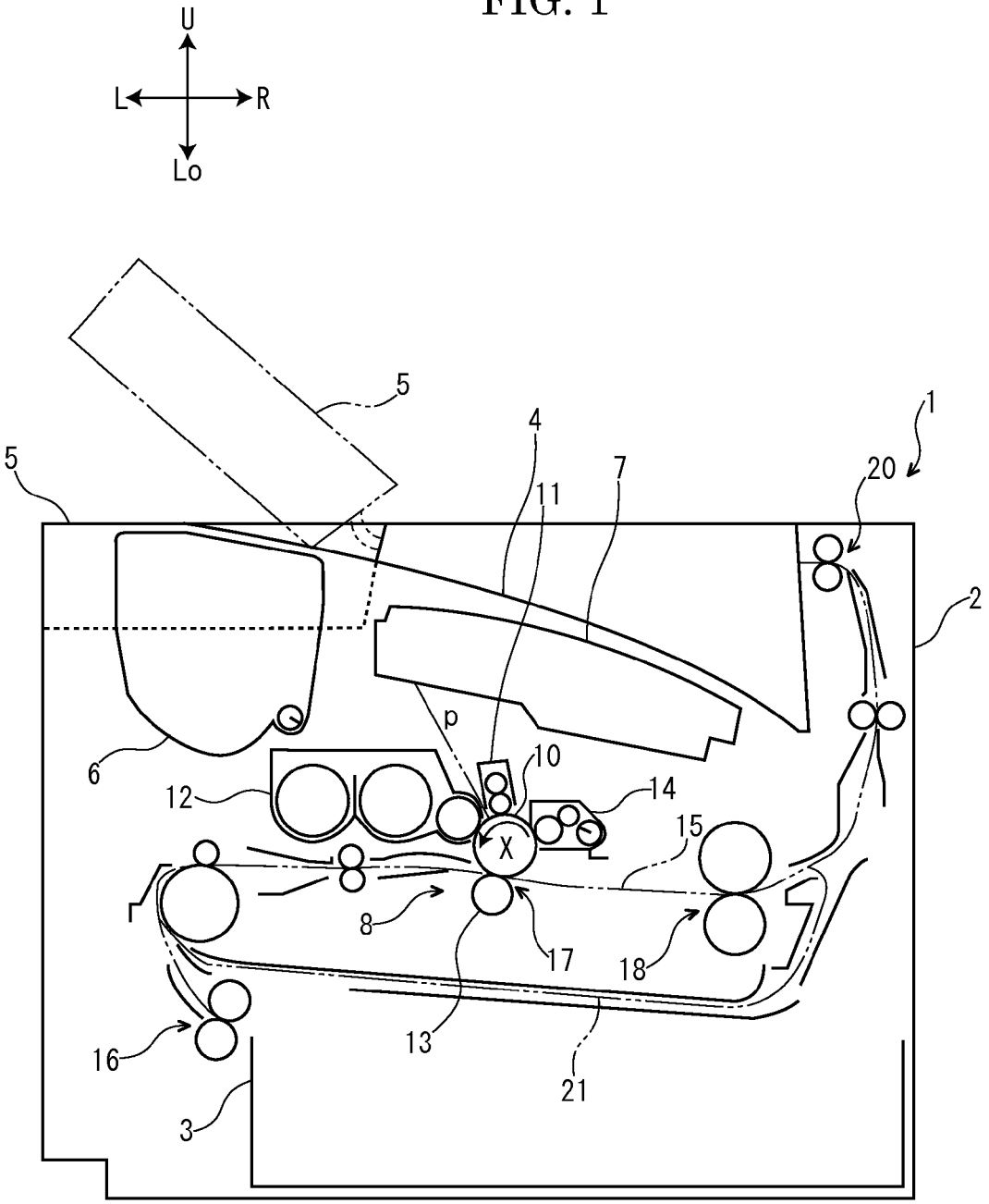
FIG. 1 is a schematic diagram showing a printer according to a first embodiment of the present disclosure.

First, with reference to FIG. 1, the entire structure of an electrographic printer 1 (an image forming apparatus) will be described. Hereinafter, it will be described so that the front side of the printer 1 is positioned at the front side of FIG. 1. Arrows Fr, Rr, L, R, U and Lo appropriately added to each of the drawings indicate the front side, rear side, left side, right side, upper side and lower side of the printer 1, respectively.

The printer 1 includes a box-formed printer main body 2. In a lower part of the printer main body 2, a sheet feeding cartridge 3 configured to store sheets (recording medium) is installed and, on the top surface of the printer main body 2, a sheet ejecting tray 4 is mounted. On the top surface of the printer main body 2, an upper cover 5 is openably/closably attached at a left-hand side of the sheet ejecting tray 4 and, below the upper cover 5, a toner container 6 is installed.

In an upper part of the printer main body 2, an exposure device 7 composed of a laser scanning unit (LSU) is installed below the sheet ejecting tray 4. Below the exposure device 7, an image forming unit 8 is installed. In the image forming unit 8, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing unit 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing unit 18, is carried out. Subsequently, in the printer 1, when image data is inputted and a printing start is directed from a computer or the like connected with the printer 1, an image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 7, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing unit 18, and then, the toner image is fixed on the sheet in the fixing unit 18. The sheet with the fixed toner image is ejected from the sheet ejecting unit 20 to the sheet ejecting tray 4. Toner remained on the photosensitive drum 10 is collected by the cleaning device 14.

Next, the fixing device 18 will be described in detail with reference to FIGS. 2 and 3. Arrow Y in FIG. 2 indicates a sheet conveying direction. Arrow I in FIG. 3 indicates an inside in forward and backward directions, and arrow O in FIG. 3 indicates an outside of the forward and backward directions.

Figure 2:
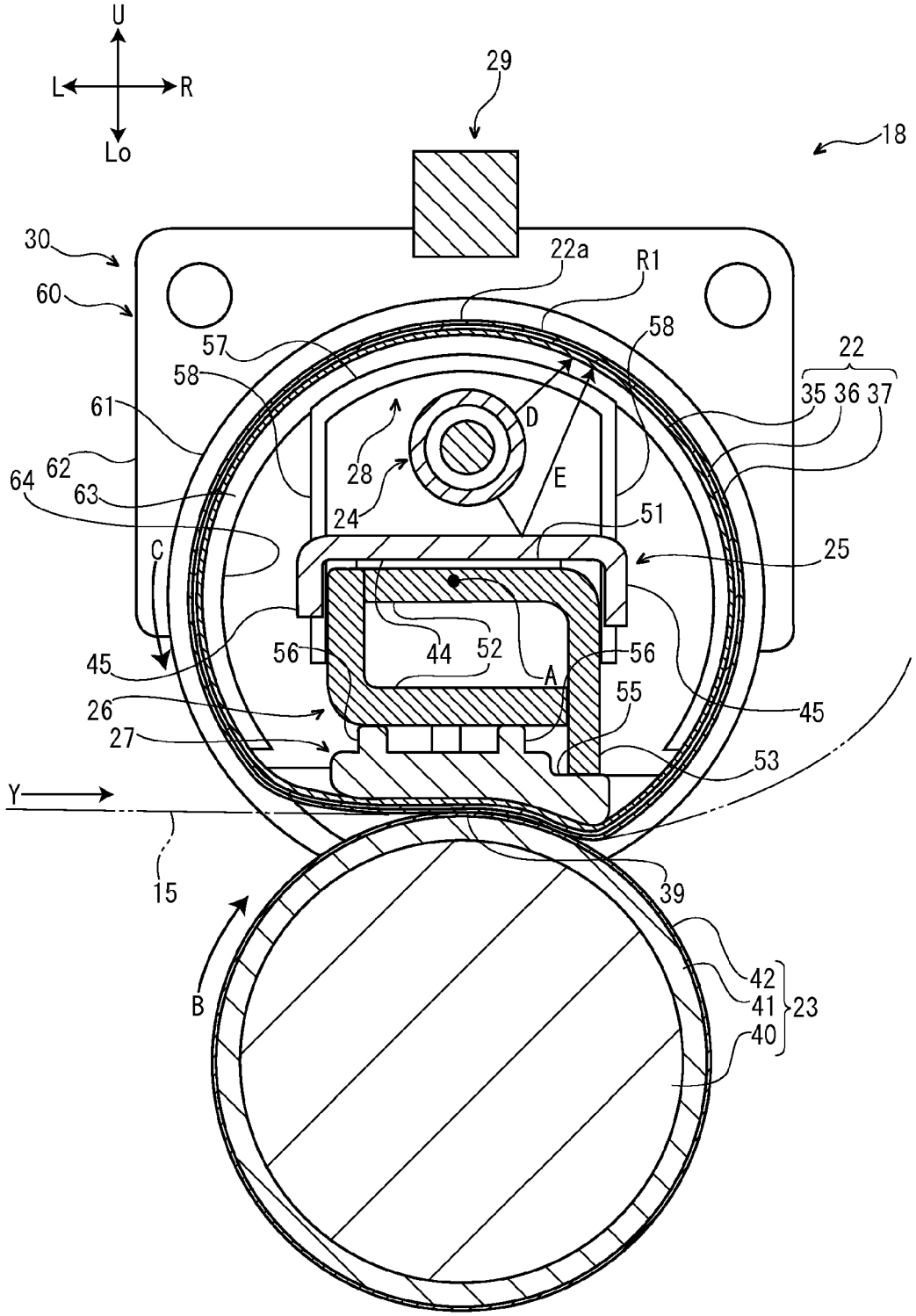
FIG. 2 is a sectional view showing a fixing device according to the first embodiment of the present disclosure.
Figure 3:
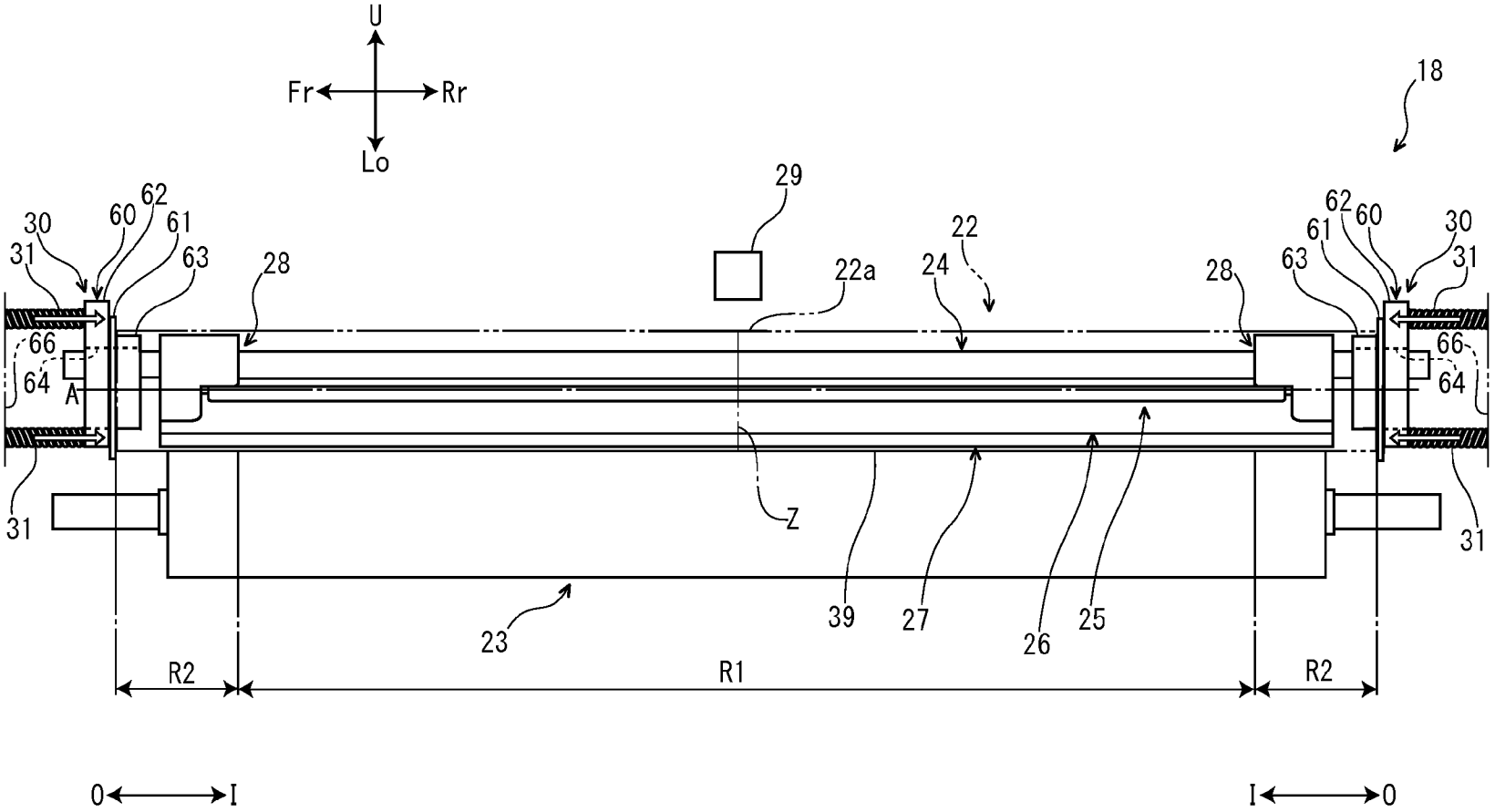
FIG. 3 is a side view showing the fixing device according to the first embodiment of the present disclosure.

As shown in FIGS. 2 and 3 and other figures, the fixing device 18 includes a fixing belt 22, a pressuring roller 23 (pressuring member) which is arranged below (outside) the fixing belt 22, a heater 24 (heat source) which is arranged at an inner diameter side of the fixing belt 22, a reflecting plate 25 (reflecting member) which is arranged at the inner diameter side of the fixing belt 22 and below the heater 24, a supporting member 26 which is arranged at the inner diameter side of the fixing belt 22 and below the reflecting plate 25, a pressing member 27 which is arranged at the inner diameter side of the fixing belt 22 and below the supporting member 26, cover members 28 which are fixed to both front and rear end parts of the supporting member 26 at the inner diameter side of the fixing belt 22, a thermocut 29 (heating stop device) which is arranged above (outside) the fixing belt 22, shape restricting members 30 which are attached to the both front and rear end parts of the fixing belt 22, and a pair of upper and lower coil springs 31 (biasing members) which are arranged at the outside in the forward and backward directions of each shape restricting member 30. In addition, FIG. 3 is a perspective view of the inside of the fixing belt 22.

The fixing belt 22 is formed in a nearly cylindrical shape elongated in the forward and backward directions. The fixing belt 22 is provided rotatably around a rotation axis A elongated in the forward and backward directions. That is, in the present embodiment, the forward and backward directions are a rotation axis direction of the fixing belt 22. The fixing belt 22 includes a sheet passing region R1 and non-sheet passing regions R2 which are provided at both front and rear sides (an outside in the forward and backward directions of the sheet passing region R1) of the sheet passing region R1. The sheet passing region R1 is a region through which sheets of a maximum size pass. Each non-sheet passing region R2 is a region through which the sheets of the maximum size do not pass.

The fixing belt 22 has flexibility, and is endless in a circumferential direction. The fixing belt 22 includes a base material layer 35, an elastic layer 36 which is provided around this base material layer 35 and a release layer 37 which covers this elastic layer 36, for example. The base material layer 35 of the fixing belt 22 is made of a metal, such as SUS or nickel. In addition, the base material layer 35 of the fixing belt 22 may be made of a resin, such as a PI (polyimide). The elastic layer 36 of the fixing belt 22 is made of a silicon rubber, for example, and has a larger thermal expansion coefficient than a thermal expansion coefficient of the base material layer 35 of the fixing belt 22. The thickness of the elastic layer 36 of the fixing belt 22 is 270 μm, for example. The release layer 37 of the fixing belt 22 is made of a PFA tube, for example. The thickness of the release layer 37 of the fixing belt 22 is 20 μm, for example.

The pressuring roller 23 is formed in a nearly columnar shape elongated in the forward and backward directions. The pressuring roller 23 comes into pressure contact with the fixing belt 22 so as to form a fixing nip 39 between the fixing belt 22 and the pressuring roller 23. The pressuring roller 23 is rotatably provided.

The pressuring roller 23 includes a columnar core material 40, an elastic layer 41 which is provided around this core material 40 and a release layer 42 which covers this elastic layer 41, for example. The core material 40 of the pressuring roller 23 is made of a metal, such as an iron. The elastic layer 41 of the pressuring roller 23 is made of a silicon rubber, for example. The release layer 42 of the pressuring roller 23 is made of a PFA tube, for example.

The heater 24 is configured as a halogen heater, for example. The heater 24 is arranged at an upper part (a part at a far side from the pressuring roller 23) in an internal space of the fixing belt 22, and is provided at a position displaced upward (the far side from the pressuring roller 23) from the rotation axis A of the fixing belt 22. Hence, in the present embodiment, an upper end part 22*a* of the fixing belt 22 is a part of the fixing belt 22 which is the closest to the heater 24.

The reflecting plate 25 is formed in a shape elongated in the forward and backward directions. The reflecting plate 25 is made of a metal, such as an aluminum alloy for brightness. The reflecting plate 25 is arranged between the heater 24 and the supporting member 26. A cross section of the reflecting plate 25 is formed in a U shape which protrudes upward (a far side from the pressuring roller 23).

The reflecting plate 25 includes a main body part 44 which is provided nearly horizontally, and guide parts 45 which are bent downward from both left and right end parts (end parts at an upstream side and a downstream side in the sheet conveying direction) of the main body part 44. A top face of the main body part 44 is a reflection face (mirror face) which faces the heater 24, and reflects a radiation heat radiated from the heater 24, to an inner circumferential face of the fixing belt 22.

The supporting member 26 is formed in a shape elongated in the forward and backward directions. An upper part of the supporting member 26 is inserted between the guide parts 45 of the reflecting plate 25. The supporting member 26 supports the reflecting plate 25 via a spacer 51, and is not in direct contact with the reflecting plate 25. The supporting member 26 is formed by combining a pair of L-shaped sheet metals 52, and has a nearly rectangular cross-sectional shape. At a lower right corner part of the supporting member 26, an engaging protrusion 53 which protrudes downward is formed. The engaging protrusion 53 is formed by elongating one of the sheet metals 52 downward.

The pressing member 27 is formed in a long flat shape in the forward and backward directions. The pressing member 27 is made of a heat-resistant resin, such as an LCP (Liquid Crystal Polymer). At a right end part of a top face of the pressing member 27, an engaging convex part 55 is formed. The engaging convex part 55 engages with the engaging protrusion 53 of the supporting member 26. In the top face of the pressing member 27, a plurality of bosses 56 are formed so as to protrude. An upper end part of each boss 56 comes into contact with a lower face of the supporting member 26. According to the above-mentioned configuration, the supporting member 26 supports the pressing member 27, and restricts a warp of the pressing member 27.

A right side part (a part at a downstream side in the sheet conveying direction) of the lower face of the pressing member 27 is inclined downward (toward the pressuring roller 23) from the left side (an upstream side in the sheet conveying direction) to the right side (the downstream side in the sheet conveying direction). The lower face of the pressing member 27 presses the fixing belt 22 downward (toward the pressuring roller 23).

Each cover member 28 is formed in a nearly U shape when seen from a front view. A position in the forward and backward directions of each cover member 28 meets each non-sheet passing region R2 of the fixing belt 22 and has a function of blocking a radiation heat traveling from the heater 24 to each non-sheet passing region R2 of the fixing belt 22.

Each cover member 28 includes a curved part 57 which is curved upward in an arc shape, and attachment parts 58 which are bent downward from both left and right end parts (end parts at the upstream side and the downstream side in the sheet conveying direction) of the curved part 57. The curved part 57 is arranged along the inner circumferential face of the fixing belt 22. A lower end part of each attachment part 58 is attached to each one of both left and right side faces of the supporting member 26.

The thermocut 29 is a thermostat of a bimetallic type (a type which configures a contact point by using two types of metals having different thermal expansion coefficients), for example. The thermocut 29 is arranged directly above the upper end part 22*a* of the fixing belt 22 (a part of the fixing belt 22 which is the closest to the heater 24), and faces an outer circumferential face of the upper end part 22*a* of the fixing belt 22. The thermocut 29 is provided at a position meeting a forward-and-backward direction center part Z (corresponding to a forward-and-backward direction center part of the entire fixing belt 22, too) of the sheet passing region R1 of the fixing belt 22).

Each shape restricting member 30 is arranged closer to the outside in the forward and backward directions than each cover member 28. Each shape restricting member 30 includes a restricting piece 60 and a ring piece 61 which is attached to the restricting piece 60.

The restricting piece 60 of each shape restricting member 30 includes a base part 62, and a restricting part 63 which is formed in a face at an inside in the forward and backward directions of the base part 62 so as to protrude. A through-hole 64 which penetrates the base part 62 and the restricting part 63 is provided to the restricting piece 60 along the forward and backward directions, and the heater 24 penetrates this through-hole 64. The restricting part 63 is curved in an arc shape along an outer circumference of the through-hole 64, and is formed in a nearly downward C shape. The restricting part 63 is inserted in the both front and rear end parts of the fixing belt 22. Consequently, the shape of the fixing belt 22 is restricted (deformation of the fixing belt 22 is prevented).

The ring piece 61 of each shape restricting member 30 is formed in an annular shape. The ring piece 61 is attached to an outer circumference of the restricting part 63 of the restricting piece 60. The ring piece 61 is arranged at the outside in the forward and backward directions of the both front and rear end parts of the fixing belt 22, and restricts meandering of the fixing belt 22 (movement to the outside in the forward and backward directions). The ring piece 61 is arranged at the inside in the forward and backward directions of the base part 62 of the restricting piece 60, and thereby restricts movement of the ring piece 61 to the outside in the forward and backward directions.

The end part of each coil spring 31 at the outside in the forward and backward directions comes into contact with a spring bearing part 66. The spring bearing part 66 is formed in a fixing frame (not shown) in which the fixing belt 22 and the pressuring roller 23 are housed, for example. The end part of each coil spring 31 at the inside in the forward and backward directions comes into contact with a face of the base part 62 of the restricting piece 60 of each shape restricting member 30 at the outside in the forward and backward directions. As indicated by outlined arrows in FIG. 3, each coil spring 31 biases each shape restricting part 30 toward the inside in the forward and backward directions. In other words, each coil spring 31 presses each shape restricting member 30 toward the forward-and-backward direction center part Z (corresponding to the forward-and-backward direction center part of the entire fixing belt 22, too) of the sheet pas sing region R1 of the fixing belt 22. According to this, the ring piece 61 of each shape restricting member 30 presses the fixing belt 22 toward the inside in the forward and backward directions.

Figure 4:
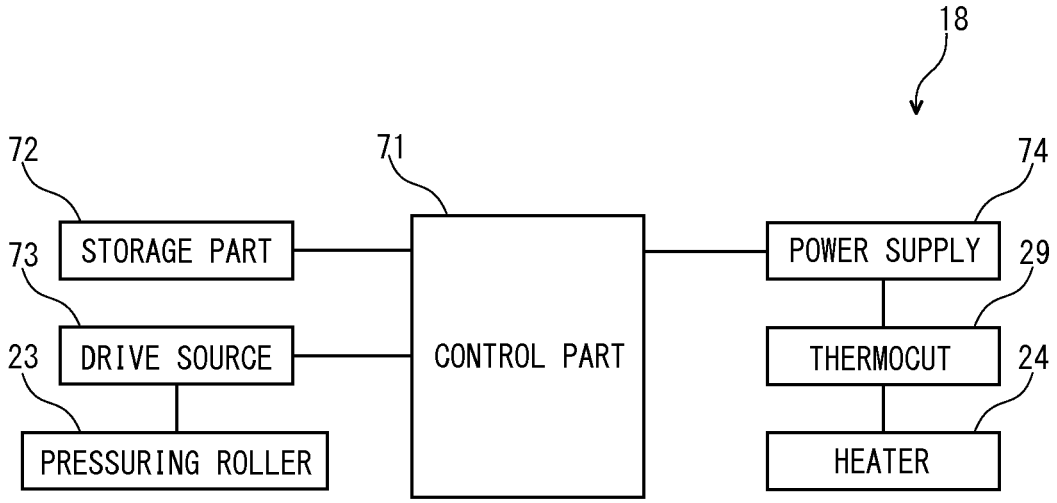
FIG. 4 is a block diagram showing a control system of the fixing device according to the first embodiment of the present disclosure.

Next, a control system of the fixing device 18 will be described with reference to FIG. 4.

The fixing device 18 includes a control part 71 (CPU). The control part 71 is connected to a storage part 72 which is configured as a storage device, such as a ROM or a RAM, and the control part 71 is configured to control each part of the fixing device 18 based on a control program or control data stored in the storage part 72. The storage part 72 stores an operating temperature T of the thermocut 29.

The control part 71 is connected to a drive source 73 configured as a motor or the like, and the drive source 73 is connected to the pressuring roller 23. Further, based on a signal from the control part 71, the drive source 73 rotates the pressuring roller 23.

The control part 71 is connected to a power supply 74, and the power supply 74 is connected to the heater 24. Further, based on a signal from the control part 71, power is supplied from the power supply 74 to the heater 24 so as to operate the heater 24. On a power supply route from the power supply 74 to the heater 24, the thermocut 29 is provided. The thermocut 29 is configured to operate at the operating temperature T, cut a power supply from the power supply 74 to the heater 24, and stop the heater 24 from heating the fixing belt 22.

To fix a toner image on a sheet in the fixing device 18 applying the above-mentioned configuration, the drive source 73 rotates the pressuring roller 23 (see arrow B in FIG. 2). When the pressuring roller 23 is rotated in this way, the fixing belt 22 which comes into pressure contact with the pressuring roller 23 is driven to rotate in a direction opposite to a direction of the pressuring roller 23 (see arrow C in FIG. 2). When the fixing belt 22 is rotated in this way, the fixing belt 22 slides against the pressing member 27.

Further, to fix a toner image on a sheet, power is supplied from the power supply 74 to the heater 24 so as to operate the heater 24. When the heater 24 is operated in this way, the heater 24 radiates a radiation heat. Part of the radiation heat radiated from the heater 24 is directly radiated on and is absorbed in the inner circumferential face of the fixing belt 22 as indicated by arrow D in FIG. 2. Further, as indicated by arrow E in FIG. 2, another part of the radiation heat radiated from the heater 24 is reflected toward the inner circumferential face of the fixing belt 22 on the top face of the main body part 44 of the reflecting plate 25, and is absorbed in the inner circumferential face of the fixing belt 22. According to the above-mentioned function, the heater 24 heats the fixing belt 22. When the sheet passes through the fixing nip 39 in this state, the toner image is heated, is melted and is fixed to the sheet.

By the way, in the fixing device 18 applying the above-mentioned configuration, even when the heater 24 stops heating the fixing belt 22 in response to the stop of the fixing belt 22, the upper end part 22*a* of the fixing belt 22 is locally heated by a remaining heat of the heater 24 and overshoots (a rise in the temperature) in some cases. There is a concern that, when a facing interval between the upper end part 22*a* of the fixing belt 22 and the thermocut 29 is too narrow, if the upper end part 22*a* of the fixing belt 22 overshoots as described above, even though the temperature of the fixing belt 22 does not excessively rise, the thermocut 29 operates. When the thermocut 29 operates once, it is difficult to restore the thermocut 29 to a state before the operation, and therefore it is generally necessary to exchange the entire fixing device 18.

To avoid such a situation, it is necessary to widen the facing interval between the upper end part 22*a* of the fixing belt 22 and the thermocut 29. However, there is a concern that, when the facing interval is widened in this way, a timing at which the thermocut 29 operates upon an excessive rise in the temperature of the fixing belt 22 delays. There is a concern that, particularly when a configuration where the pressing member 27 of a flat shape presses the fixing belt 22 downward as in the present embodiment is applied, if the fixing belt 22 is broken in the circumferential direction, the fixing belt 22 is deformed in a horizontally long elliptical shape. There is a concern that, when the fixing belt 22 is deformed in the horizontally long elliptical shape in this way, the facing interval between the upper end part 22*a* of the fixing belt 22 and the thermocut 29 further widens, and a timing at which the thermocut 29 operates further delays. Hence, in the present embodiment, even when the fixing belt 22 is broken in the circumferential direction, the thermocut 29 is operated at an adequate timing as follows.

As shown in FIG. 3, in normal use of the fixing belt 22 (when the fixing belt 22 is not broken in the circumferential direction), the upper end part 22*a* of the fixing belt 22 faces the thermocut 29 with a constant interval.

Figure 5:
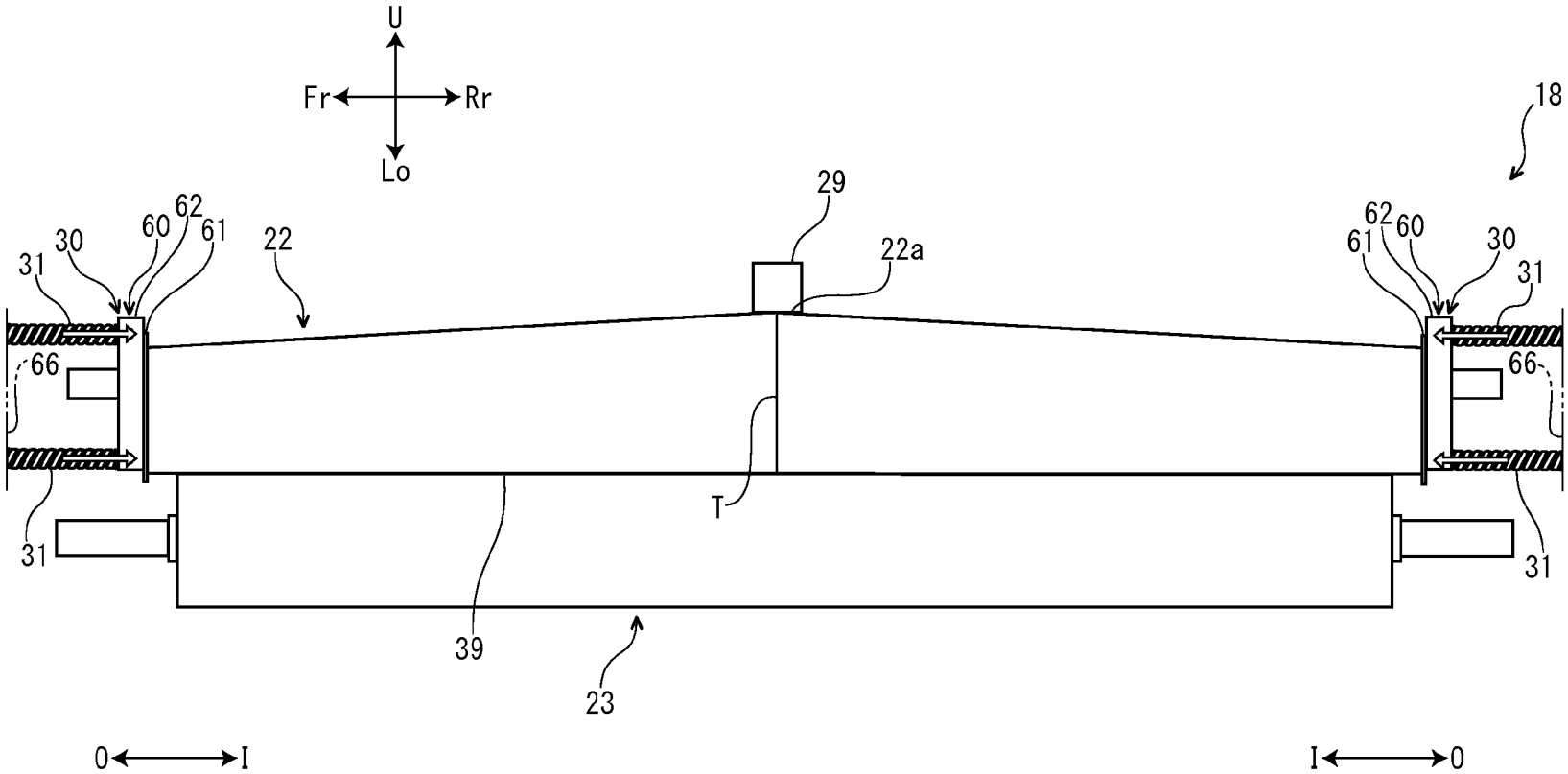
FIG. 5 is a side view showing a state that a fixing belt is broken in the circumferential direction according to the first embodiment of the present disclosure.

By contrast with this, as shown in FIG. 5, when the fixing belt 22 is broken along a broken part T in the circumferential direction, the biasing force of each coil spring 31 moves each shape restricting member 30 toward the inside in the forward and backward directions, and each shape restricting member 30 presses the fixing belt 22 toward the inside in the forward and backward directions. This press bulges (deforms) the upper end part 22*a* of the fixing belt 22 upward (a close side to the thermocut 29), and places the upper end part 22*a* in contact with the thermocut 29. According to this, the temperature of the thermocut 29 reaches the operating temperature T, the thermocut 29 operates and power supply from the power supply 74 to the heater 24 is stopped. Hence, the heater 24 also stops heating the fixing belt 22.

In the present embodiment, when the fixing belt 22 is broken in the circumferential direction as described above, it is possible to narrow the facing interval between the upper end part 22*a* of the fixing belt 22 and the thermocut 29 (to 0 in the present embodiment). Consequently, it is possible to operate the thermocut 29 at an adequate timing.

Further, this mechanism narrows the facing interval between the upper end part 22*a* of the fixing belt 22 and the thermocut 29 when the fixing belt 22 is broken in the circumferential direction. Hence, it is not necessary to narrow the facing interval between the upper end part 22*a* of the fixing belt 22 and the thermocut 29 so as not to widen the upper end part 22*a* of the fixing belt 22 and the thermocut 29 too much when the fixing belt 22 is broken in the circumferential direction. Consequently, it is possible to set a wide facing interval between the upper end part 22*a* of the fixing belt 22 and the thermocut 29, and avoid a situation that the thermocut 29 operates even though the temperature of the fixing belt 22 does not excessively rise.

Further, when the upper end part 22*a* of the fixing belt 22 is bulged (deformed) upward (a close side to the thermocut 29), the upper end part 22*a* of the fixing belt 22 comes into contact with the thermocut 29 and the thermocut 29 operates. By applying such a configuration, when the fixing belt 22 is broken in the circumferential direction, it is possible to cause the temperature of the thermocut 29 to reliably reach the operating temperature T and reliably cause the thermocut 29 to operate.

Further, the heater 24 is arranged at the inner diameter side of the fixing belt 22 and is provided at a position displaced upward (the far side from the pressuring roller 23) from the rotation axis A of the fixing belt 22, and the thermocut 29 faces the outer circumferential face of the upper end part 22*a* of the fixing belt 22 (the part of the fixing belt 22 which is the closest to the heater 24). The upper end part 22*a* of the fixing belt 22 is a part of the fixing belt 22 whose temperature is the most likely to excessively rise and therefore, by arranging the thermocut 29 so as to face the outer circumferential face of the upper end part 22*a* of the fixing belt 22 as described above, it is possible to reliably prevent an excessive rise in the temperature of the fixing belt 22.

Further, each shape restricting member 30 includes the restricting piece 60 which is partially inserted in each of the both front and rear end parts of the fixing belt 22, and the ring piece 61 which is attached to the restricting piece 60 and is arranged at the outside in the forward and backward directions of the both front and rear end parts of the fixing belt 22, and each coil spring 31 comes into contact with the face of the restricting piece 60 at the outside in the forward and backward directions. By applying such a configuration, it is possible to prevent the fixing belt 22 from deforming or meandering and bias each shape restricting member 30 while employing a simple configuration.

In the present embodiment, a case where the heater 24 composed of the halogen heater is used as a heat source has been described. Meanwhile, in the other different embodiments, a ceramic heater or the like may be used as the heat source.

In the present embodiment, a case where the configuration of the present disclosure is applied to the printer 1 has been described. Meanwhile, in the other different embodiments, the configuration of the disclosure may be applied to another image forming apparatus, such as a copying machine, a facsimile or a multifunction peripheral.

Second Embodiment

Next, a fixing device 81 according to the second embodiment of the present disclosure will be described with reference to FIG. 6. In addition, components other than an interval sensor 82 are the same as the components of the fixing device 18 according to the first embodiment, and therefore will not be described.

Figure 6:
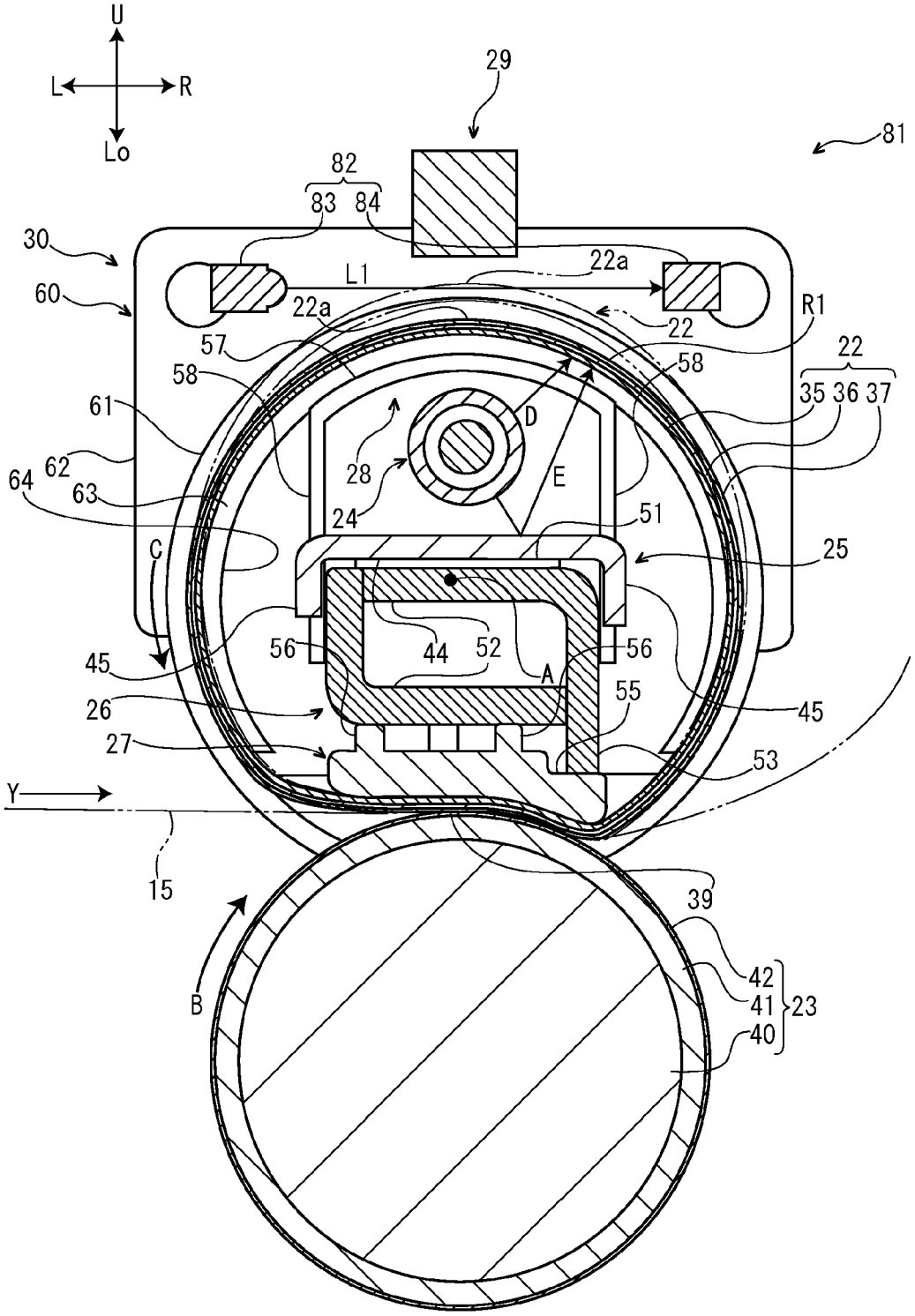
FIG. 6 is a sectional view showing a fixing device according to a second embodiment of the present disclosure.

As shown in FIG. 6, the fixing device 81 includes the interval sensor 82 near the fixing belt 22. The interval sensor 82 is an optical sensor, such as a PI sensor (Photo Interrupter Sensor), and includes a light emitting part 83 which emits sensor light (see arrow L1 in FIG. 6) and a light receiving part 84 which receives sensor light emitted from the light emitting part 83. Similar to the thermocut 29, the light emitting part 83 and the light receiving part 84 of the interval sensor 82 are provided at positions meeting the forward-and-backward direction center part Z (corresponding to the forward-and-backward direction center part of the entire fixing belt 22, too) of the sheet passing region R1 of the fixing belt 22.

In normal use of the fixing belt 22 (when the fixing belt 22 is not broken in the circumferential direction) in the fixing device 81 applying the above-mentioned configuration, as indicated by a solid line in FIG. 6, the upper end part 22*a* of the fixing belt 22 faces the thermocut 29 with a predetermined interval, and the facing interval between the upper end part 22*a* of the fixing belt 22 and the thermocut 29 is wider than a standard interval S (0<S) stored in the storage part 72. In this state, sensor light emitted from the light emitting part 83 of the interval sensor 82 travels straightforward along the left and right directions (a direction orthogonal to the rotation axis direction of the fixing belt 22), passes through the facing interval between the upper end part 22*a* of the fixing belt 22 and the thermocut 29 and reaches the light receiving part 84 of the interval sensor 82. According to this, the interval sensor 82 detects that the facing interval between the upper end part 22*a* of the fixing belt 22 and the thermocut 29 is not the standard interval S (0<S) or less, and outputs this detection result to the control part 71. In this case, the control part 71 causes the heater 24 to continue heating the fixing belt 22.

By contrast with this, when the fixing belt is broken in the circumferential direction, as indicated by two-dot chain lines in FIG. 6, according to the same function as the function in the first embodiment, the upper end parts 22*a* of the fixing belt bulges (deforms) upward (the close side to the thermocut 29) and comes close to the thermocut 29. According to this, the facing interval between the upper end part 22*a* of the fixing belt 22 and the thermocut 29 becomes the standard interval S or less. In this state, the sensor light emitted from the light emitting part 83 of the interval sensor 82 is blocked by the upper end part 22*a* of the fixing belt 22, and does not reach the light receiving part 84 of the interval sensor 82. According to this, the interval sensor 82 detects that the facing interval between the upper end part 22*a* of the fixing belt 22 and the thermocut 29 has become the standard interval S or less, and outputs this detection result to the control part 71. In this case, the control part 71 stops the heater 24 from heating the fixing belt 22.

By applying such a configuration, when the fixing belt 22 is broken in the circumferential direction, before the upper end part 22*a* of the fixing belt 22 comes into contact with the thermocut 29 and the thermocut 29 operates (before the temperature of the thermocut 29 reaches the operating temperature T), it is possible to stop the heater 24 from heating the fixing belt 22. According to this, it is possible to avoid the operation of the thermocut 29 as much as possible, and prevent as much as possible a situation that it is necessary to exchange the entire fixing device 81 in response to the operation of the thermocut 29.

In the present embodiment, a case where the light emitting part 83 and the light receiving part 84 of the interval sensor 82 are provided at the positions meeting the forward-and-backward direction center part Z (corresponding to the forward-and-backward direction center part of the entire fixing belt 22, too) of the sheet passing region R1 of the fixing belt 22. On the other hand, in other different embodiments, the light emitting part 83 of the interval sensor 82 may be provided at a position meeting one end part (e.g. front end part) of the fixing belt 22, and the light receiving part 84 of the interval sensor 82 may be provided at a position meeting the other end part (e.g. rear end part) of the fixing belt 22. By applying such a configuration, sensor light emitted from the light emitting part 83 of the interval sensor 82 travels straightforward along the forward and backward directions (the rotation axis direction of the fixing belt 22), passes from one end part of the fixing belt 22 to the other end part and then reaches the light receiving part 84 of the interval sensor 82. According to this, irrespective of at which position in the forward and backward directions the fixing belt 22 is broken in the circumferential direction, it is possible to reliably detect that the fixing belt 22 is broken in the circumferential direction.

Third Embodiment

Next, a fixing device 91 according to the third embodiment of the present disclosure will be described with reference to FIG. 7. In addition, components other than a movement sensor 92 are the same as the components of the fixing device 18 according to the first embodiment, and therefore will not be described.

Figure 7:
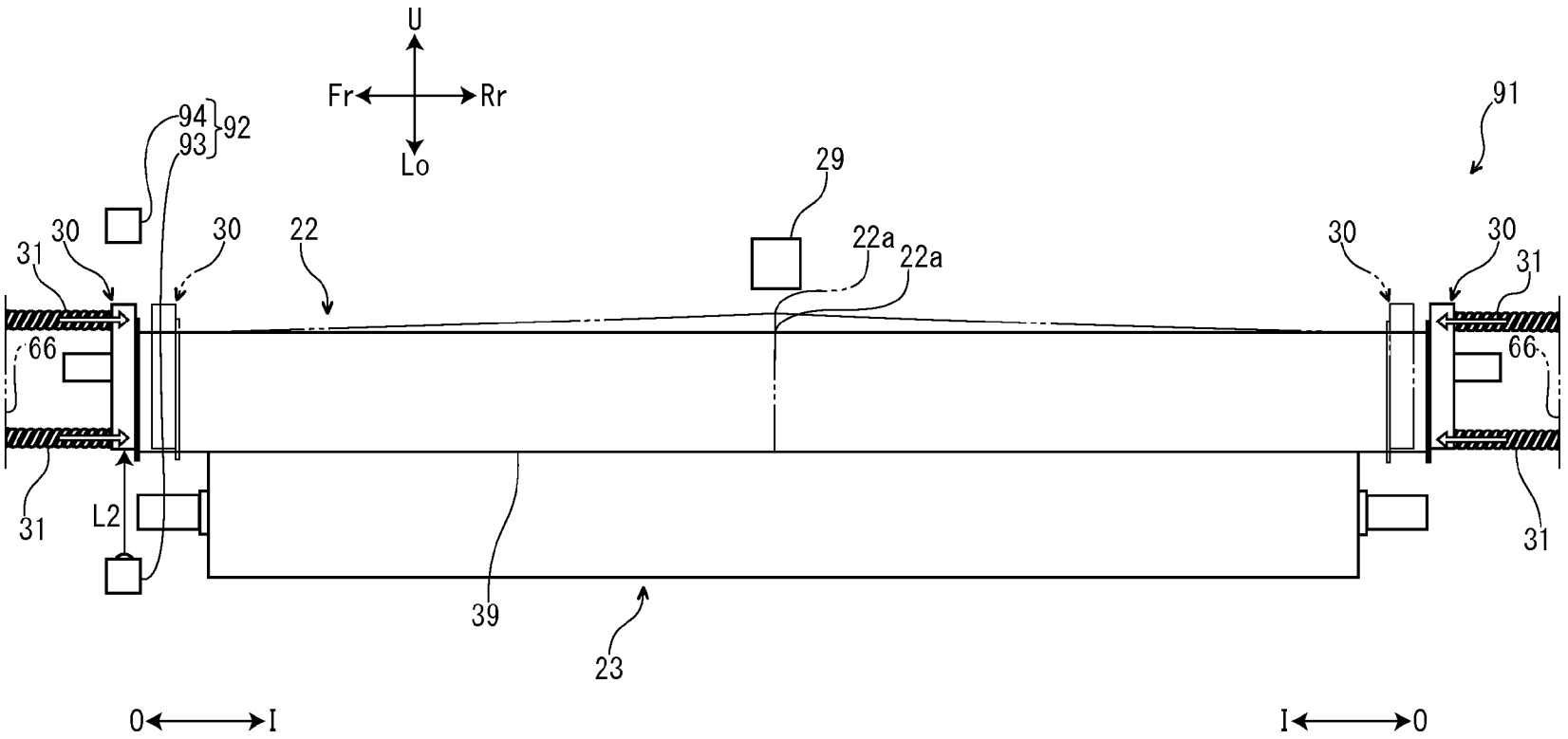
FIG. 7 is a side view showing a fixing device according to a third embodiment of the present disclosure.

As shown in FIG. 7, the fixing device 91 includes the movement sensor 92 near the front shape restricting member 30. The movement sensor 92 is an optical sensor, such as a PI sensor (Photo Interrupter Sensor), and includes a light emitting part 93 which emits sensor light (see arrow L2 in FIG. 7) and a light receiving part 94 which receives sensor light emitted from the light emitting part 93.

In normal use of the fixing belt 22 (when the fixing belt 22 is not broken in the circumferential direction) in the fixing device 91 applying the above-mentioned configuration, as indicated by a solid line in FIG. 7, the front shape restricting member 30 is arranged at a predetermined position. In this state, sensor light emitted from the light emitting part 93 of the movement sensor 92 is blocked by the front shape restricting member 30 and does not reach the light receiving part 94 of the movement sensor 92. According to this, the movement sensor 92 detects that the front shape restricting member 30 does not move toward the inside in the forward and backward directions by a standard movement amount M (0<M) or more stored in the storage part 72, and outputs this detection result to the control part 71. In this case, the control part 71 causes the heater 24 to continue heating the fixing belt 22.

By contrast with this, when the fixing belt is broken in the circumferential direction, as indicated by two-dot chain lines in FIG. 7, according to the same function as the function in the first embodiment, each shape restricting member 30 moves toward the inside in the forward and backward directions, and the upper end parts 22*a* of the fixing belt 22 bulges (deforms) upward (the close side to the thermocut 29) and comes close to the thermocut 29. When each shape restricting member 30 moves toward the inside in the forward and backward directions as described above, sensor light emitted from the light emitting part 93 of the movement sensor 92 reaches the light receiving part 94 of the movement sensor 92 without being blocked by the front shape restricting member 30. According to this, the movement sensor 92 detects that the front shape restricting member 30 has moved toward the inside of the forward and backward directions by the standard movement amount M or more, and outputs this detection result to the control part 71. In this case, the control part 71 stops the heater 24 from heating the fixing belt 22.

By applying such a configuration, when the fixing belt 22 is broken in the circumferential direction, before the upper end part 22*a* of the fixing belt 22 comes into contact with the thermocut 29 and the thermocut 29 operates (before the temperature of the thermocut 29 reaches the operating temperature T), it is possible to stop the heater 24 from heating the fixing belt 22. According to this, it is possible to avoid the operation of the thermocut 29 as much as possible, and prevent as much as possible a situation that it is necessary to exchange the entire fixing device 91 in response to the operation of the thermocut 29.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt configured to be rotatable around a rotation axis;

a pressuring member configured to be rotatable and to come into pressure contact with the fixing belt so as to form a fixing nip;

a heat source configured to heat the fixing belt;

a pressing member configured to press the fixing belt to a side of the pressuring member;

a heating stop device configured to face an outer circumferential face of the fixing belt and to operate at an operating temperature so as to stop the heat source from heating the fixing belt;

shape restricting members attached to both end parts of the fixing belt and configured to restrict a shape of the fixing belt; and biasing members configured to bias the shape restricting members toward an inside in a direction of the rotation axis, wherein, when the fixing belt is broken in a circumferential direction, the shape restricting members move toward the inside in the direction of the rotation axis by biasing force of the biasing members and the shape restricting members press the fixing belt toward the inside in the direction of the rotation axis so that at least a part of the fixing belt is deformed to a close side to the heating stop device.

2. The fixing device according to claim 1, wherein, when at least the part of the fixing belt is deformed to the close side to the heating stop device, the fixing belt comes into contact with the heating stop device and the heating stop device operates.

3. The fixing device according to claim 1, further comprising:

an interval sensor configured to detect whether or not a facing interval between the fixing belt and the heating stop device has become a standard interval or less; and a control part configured to stop the heat source from heating the fixing belt when the interval sensor detects that the facing interval between the fixing belt and the heating stop device has become the standard interval or less.

4. The fixing device according to claim 1, further comprising:

a movement sensor configured to detect whether or not one of the shape restricting members moves toward the inside in the direction of the rotation axis by a standard movement amount or more; and a control part configured to stop the heat source from heating the fixing belt when the movement sensor detects that the one of the shape restricting members has moved toward the inside in the direction of the rotation axis by the standard movement amount or more.

5. The fixing device according to claim 1, wherein the heat source is arranged at an inner diameter side of the fixing belt and provided at a position displaced from the rotation axis, and the heating stop device faces an outer circumferential face of a closest part to the heat source of the fixing belt.

6. The fixing device according to claim 1, wherein each shape restricting member includes:

a restricting piece which is at least partially inserted into each of the both end parts of the fixing belt; and a ring piece attached to the restricting piece and arranged at an outside in the direction of the rotation axis of each of the both end parts of the fixing belt, and each biasing member comes into contact with a face of the restricting piece at the outside in the direction of the rotation axis.

7. The fixing device according to claim 6, wherein the restricting piece is provided with a through-hole formed along the direction of the rotation axis, and the heat source penetrates the through-hole.

8. The fixing device according to claim 1, further comprising:

a supporting member configured to support the pressing member; and a reflecting member arranged between the heat source and the supporting member, wherein the supporting member supports the reflecting member via a spacer, and is not in contact with the reflecting member.

9. The fixing device according to claim 1, wherein the heating stop device is provided at a position corresponding to a center part of the fixing belt in the direction of the rotation axis.

10. An image forming apparatus comprising the fixing device according to claim 1.

* * * * *